US005902035A

United States Patent [19]

Mui

[11] Patent Number: 5,902,035

[45] Date of Patent: May 11, 1999

[54] LIGHTING FIXTURE FOR CLEANROOM AND CONTAINMENT ENVIRONMENTS

[75] Inventor: Yanwai Mui, Skokie, Ill.

[73] Assignee: Kenall Manufacturing Co., Gurnee, Ill.

[21] Appl. No.: 08/839,043

[22] Filed: Apr. 23, 1997

[51] Int. Cl.[6] ..... F21V 31/02

[52] U.S. Cl. ..... 362/267; 362/147; 362/217; 362/406

[58] Field of Search ..... 362/267, 227, 362/217, 218, 147, 406

[56] References Cited

U.S. PATENT DOCUMENTS

| | | | |
|---|---|---|---|
| 2,327,552 | 8/1943 | Poehling | 362/227 |
| 2,744,716 | 5/1956 | Zingone | 362/147 |
| 2,873,358 | 2/1959 | Dunker | 362/267 |
| 3,015,721 | 1/1962 | Guth, Jr. | 362/217 |
| 3,064,851 | 11/1962 | Guigli | 362/147 |
| 3,134,498 | 5/1964 | Serio et al. | 362/217 |
| 3,228,645 | 1/1966 | Zurawski et al. | 362/147 |
| 3,686,496 | 8/1972 | Totten et al. | 362/217 |
| 4,171,535 | 10/1979 | Westerman | 362/406 |
| 4,461,205 | 7/1984 | Shuler | 362/218 |
| 5,171,085 | 12/1992 | Jaksich | 362/147 |

FOREIGN PATENT DOCUMENTS

| | | | |
|---|---|---|---|
| 1489335 | 3/1969 | Germany . | |
| 1489335 | 4/1969 | Germany | 362/147 |
| 2943544 | 5/1981 | Germany | 362/147 |

*Primary Examiner*—Sandra O'Shea
*Assistant Examiner*—Marshall Honeyman
*Attorney, Agent, or Firm*—Michael G. Berkman

[57] ABSTRACT

A lighting fixture for sealed emvironments including cleanroom and containment environments. There is described a recessed, ceiling-mounted fixture which has a one-piece, seam-welded housing, and which carries swing out mounts. The fixture is further characterized by an improved system by which its lens assembly, which employs a specially-shaped lens frame and a uniquely-contoured, one-piece gasket, is doubly sealed, firmly and evenly. against the fixture housing and the ceiling in which the fixture is mounted. A unique and functionally significant feature of the fixture is the provision of a support fulcrum bracket which is positioned radially inwardly of the fixture securment screws. The support fulcrum bracket functions, in conjunction with a cooperating screw fastener, to reverse the fulcrum point of fixture constructions of this type, thereby drawing the lens frame and gasket system in consistent and reliable contact with the ceiling structure. The bracket also serves to ensure the preservation and retention of a planar configuration of the lens-carrying assembly, while effectively eliminating over-torque problems which otherwise commonly occur. Thus, the present invention ensures improved, positive, perimetric seals with the housing and at the ceiling. Such seals are not currently not available, to this extent, in sheet metal lighting fixtures being used for these applications.

22 Claims, 2 Drawing Sheets

LIGHTING FIXTURE FOR CLEANROOM AND CONTAINMENT ENVIRONMENTS

FIELD AND BACKGROUND OF THE INVENTION

The present invention relates to an electrical lighting fixture. More particularly, the invention is directed to a recessed, ceiling-mounted lighting fixture constituting a sealed enclosure and specially adapted for use in a "clean room" or in a containment environment.

Typically, the present invention is uniquely suited for use where it is required or desired to establish and to maintain an ambient system which is free of materials or substances which are "foreign" to the system sought to be established and maintained. In order to establish and to maintain and perpetuate the pristine and "sterile" atmosphere and environment referred to, it is necessary not only that the electrical fixtures themselves be inert, impervious and completely sealed, but also that the fixtures are so designed, engineered and constructed as to establish, when properly installed, a particulate and fluid-impervious seal with the ceiling itself in which the fixtures are mounted for use.

It will be appreciated that electrical fixtures of the general type referred to are specially desired and sought in broad and diverse places, and for many and exceedingly varied purposes. Typically, lighting fixtures of the type herein described are especially useful in hospitals, in research and development laboratories including biological research laboratories, in laboratories carrying out research and developmental work on sophisticated electrical and/or electronic devices such as computer hardware components, in laboratories, power stations and other establishments where radio-active substances are used, in pharmaceutical plants, as well as in other locales, and to achieve other purposes.

A particularly vexing and challenging problem in the installation of recessed electrical fixtures, for the purposes and uses exemplified above, involves and is posed by "seals" which must be established. Specifically, an end to be achieved is to provide a configuration, design, structure and method of installation which will establish a positive, uninterrupted and sustained and effective seal between the fixture and the outer surface of the ceiling (or other surface) engaged by the fixture when it is inserted in place to assume its recessed disposition.

Some installations, in prior art systems, rely on the use of caulking materials or mastics as interface materials interposed between the fixture and the ceiling to establish seals. The efficacy of such installations is often short lived, due, for example, to drying and shrinking, or general breakdown of the medium employed. Moreover, the sealant composition may itself contribute contaminants to the contained environment. In other arrangements, gaskets have been used. Torsion forces, and bending or bowing of the bounding, gasket-engaging peripheral rim of the fixtures, generated during the process of fixture installation often damage, compromise, and often negate the establishment of a truly effective or sustained seal. Still other installations are unduly complex, while without compensating improvements in operation, and without enhancing efficacy.

It is, therefore, a principal aim of the present invention to obviate shortcomings in prior art recessed electrical fixtures and to provide significant improvements, in not only configuration, construction, and physical composition, but also in the manner and mode by which a more effective and more reliable seal, of increased life, is structured and installed.

SUMMARY OF THE INVENTION

The present invention provides a recessed electrical fixture of the type installable in a ceiling. The fixture includes a one-piece, sealed, fluid-impenetrable housing, and an improved sealing assembly utilizing a specially-shaped lens plate and a uniquely-configured gasket. The invention also teaches a novel means by which bending and distortion of the sealing assembly, including the lens plate, during installation of the fixture is prevented. The sealing of the fixture at the ceiling is rendered more effective and more reliable. The cross-section, depth, disposition and composition of the gasket of the fixture disclosed herein are additional features which contribute to the improved perfomance and the enhanced and extended life of the seals established in accordance with the detailed teachings of the present invention.

A principal feature of the invention is the provision of mechanical means by which to prevent distortion and deformities in the lens support assembly, and particularly in the lens frame or plate, ordinarily tending to occur or to be produced during draw-up of the lens assembly toward, to engage the housing of the fixture, or the ceiling. Such distortion and deformities have the serious effect of imparing any seal to be established between the lens assembly of the lighting fixture and the overlying ceiling substrate.

In a preferred embodiment of the invention the housing of the fixture includes, as an interior mechanical structural component thereof, a support fulcrum bracket facilitating the attachment of a lens assembly of the invention in a functional, effectively-sealed mode.

It is a feature of the invention that the support fulcrum bracket includes a side wall displaced inwardly of, projecting downwardly, and generally paralleling an outer side wall of the fixture.

In a preferred embodiment of the invention the downwardly-directed side wall of the support fulcrum bracket of the invention terminates in an integrally formed foot-like plate extending normally of the side wall for abutting and bearing upon the lens and upon the lens frame which underlies and supports the lens.

A related and exceedingly important feature of the invention is the critical role played by the support fulcrum bracket. During the process of attaching the lens assembly to the housing of the fixture, and during the "draw-up" of the lens assembly to establish the seal between the gasket of the fixture and the fixture housing and the ceiling structure, the side wall of the support fulcrum bracket, as it abuts and bears on the lens, acts effectively to prevent such bending and physical distortion of the lens and the lens assembly components as would have the effect of impairing or compromising the seal.

For the seal effectively to prevent the entrance of fluid and particulate matter to the interior of the fixture and the ceiling cavity above the fixture, the lens assembly fastening means needs to apply a significant force to compress the lens assembly to the ceiling and fixture housing. In structures of the prior art, what occurs during the process of drawing the lens assembly up to the fixture and ceiling is that the edge of the lens frame contacts the fixture housing, first to establish contact, and then begins to establish the sought for seal. In such structures, the fact that the fastener is located inside the fixture relative to the lens assembly/fixture housing joint results in a bending moment with the fulcrum point to the outside of the fastener at the lens assembly/fixture housing joint. Under these conditions, tightening the fastener to the degree required to achieve the necessary compressive forces has the effect of lifting the outer edge of the lens assembly compromising the seal at the lens assembly/ceiling joint. A very important feature of the present invention is to move the fulcrum so it is inside the fastening means so that increased tightening of the fastener creates the desired compressive forces at the lens assembly/fixture housing joint and at the lens assembly/fixture ceiling joint.

That is, with the support fulcrum bracket positioned to the inside of the fastening means (or draw up screw), advancement of the screw has the effect of pivoting the outer, peripheral edge of the lens assembly and its gasket toward the ceiling, thereby to enhance the seal between the bounding edge of the fixture and the ceiling.

It is an important feature of the invention that it includes a lens support assembly including a lens, a lens frame, and a gasket, the lens being in an out-of-contact relationship with respect to the gasket and being disposed radially inwardly of the gasket.

A related feature of the invention is that the lens support assembly includes a structural bridge having walls extending upwardly and inwardly, the bridge walls diverging, and free lower ends of the bridge walls or legs bearing respectively on the spatially-separated gasket and lens of the fixture.

An additional structural component of the lens support assembly of the invention is a coupler or interior framing member consisting of an elongate angle bar.

In the embodiment of the invention illustrated, the framing member is shown as having longitudinally-extending legs (or arms) joined to one another at an acute angle. One leg of the structural coupler overlies the lens plate, in positive abutment therewith. The other leg extends interiorly within and along the bridge, in face-to-face contact with that wall of the bridge which bears on the lens of the fixture. This leg of the coupler is secured to the abutting, coextensive wall of the bridge. In the illustrated embodiment, screws are used.

It is a feature of a preferred embodiment of the invention that the bridge walls which span between and bear upon the sealing gasket and the lens are integrally formed at their lower ends with elongate, coextensive flange-like feet or webs. These feet bear, respectively, on the sealing gasket of the lens assembly and upon the lens, at an inner surface thereof.

It is a feature of the lighting fixture of the invention that the housing is provided with mounting brackets which are secured to the housing. The brackets are vertically readily adjustable, and are conveniently swingable to project outwardly of the housing so as to engage and bear upon a fixed structural lattice-like framing or grid work, of known configuration, thereby to support the housing in a recessed mode.

In a preferred embodiment of the invention, the swing-out mounting brackets include readily adjustable mechanisms by which the brackets may be urged into positive stressing engagement with the supporting structures, and locked thereagainst.

In the illustrated embodiment of the invention, the swing-out brackets are threadedly mounted on a vertical screw, which is itself secured to a side wall of the housing of the fixture. A locking nut threaded on the screw in a zone above the bracket functions to bear upon the bolt and hold the swing-out bracket fixed before the fixture is installed.

It is a feature of the present invention that the lens assembly including the lens frame, the lens carried by the frame, as well as the sealing gasket, the bridge structure, and the coupling or framing member are simply, expeditiously, and conveniently attached to and drawn upwardly toward the housing of the fixture, and ultimately into sealing engagement with the overlying ceiling substrate, by the simple expedient of screws.

It is a feature of the invention that there are provided vertically aligned bores, holes or openings through which the securement and draw-up screws are upwardly inserted, through the base members, including the lens frame, the framing member which overlies the lens frame, and through the bridge spanning between the sealing gasket and the lens.

In the illustrated embodiment of the invention the leading end of the securement and draw-up screw, upon passing through the aligned openings in the lens assembly, is threadedly received and engaged within a nut captively held in a top, horizontal, wall of a bracket secured to the housing of the fixture, interiorly thereof.

It is a feature of the invention that as the attachment screw is rotated to advance into the captive nut in the housing, the lens assembly is drawn upwardly. The sealing gasket is brought into abutment with an outwardly projecting flange of the housing of the fixture and the downwardly extending stabilizing and support arm carried by the housing comes to bear downwardly against the lens retained in the lens assembly.

It is an important feature of the invention that the "support arm" carried by the housing of the fixture engages the lens along a zonal locus or lineal path which is radially inwardly of the fastener screws.

It is a feature of the invention that the housing of the fixture is a one-piece, seam-welded construction, with a urethane powder coat finish.

Yet another important feature of the fixture of the invention is that the lens frame is fabricated of cold-rolled or stainless steel, and is formed with a one-piece, 60 degree beveled perimeter.

Other and further objects, features and advantages of the invention will be evident from a reading of the following description considered in conjunction with the drawings.

DESCRIPTION OF ILLUSTRATED EMBODIMENT

Figures 1, 2, 3:
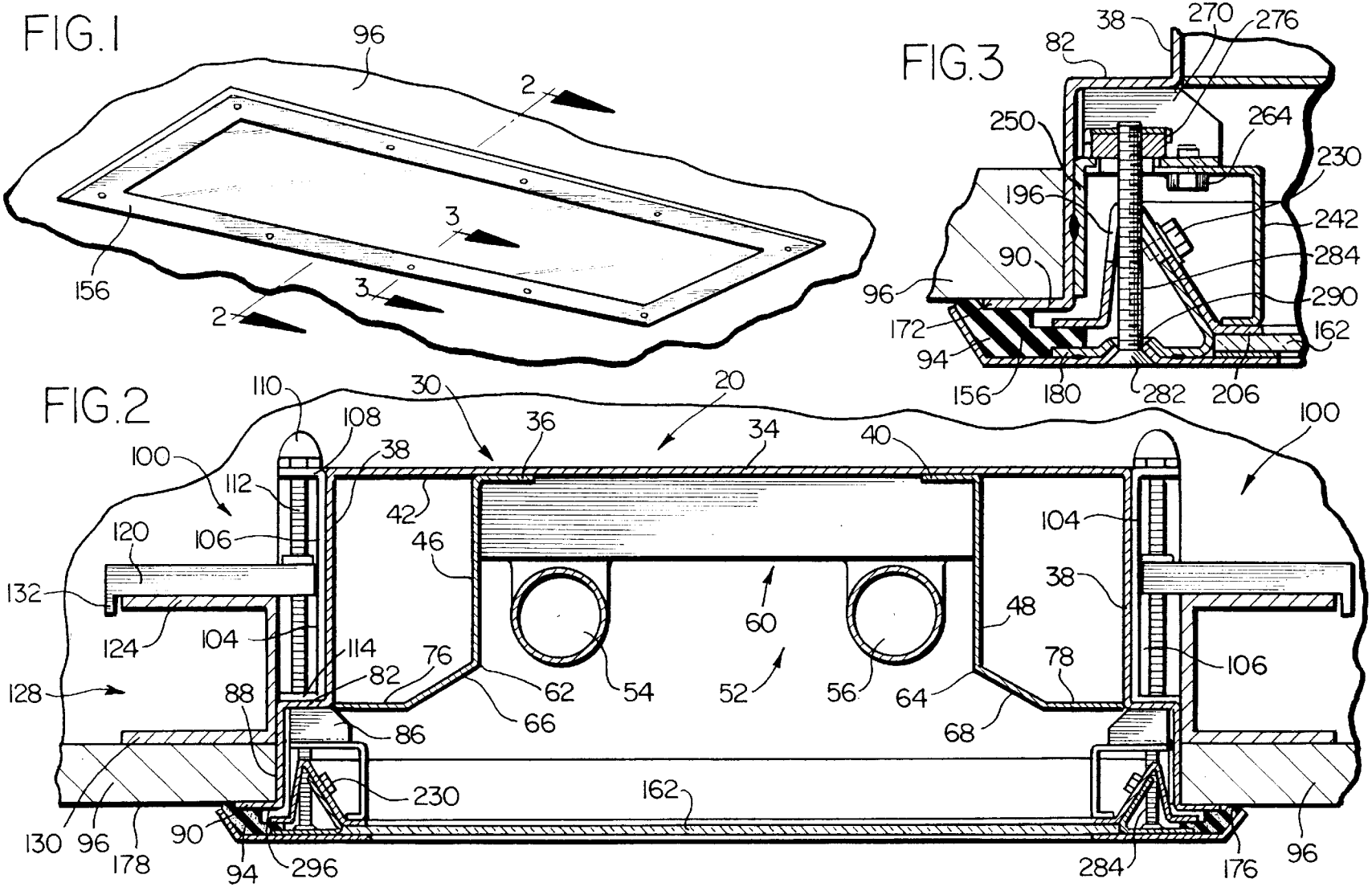
FIG. 1 is a perspective view showing a recessed lighting fixture, according to the present invention, secured in a ceiling.
FIG. 2 is a cross-sectional view taken substantially on the lines 2–2 of FIG. 1.
FIG. 3 is a cross-sectional view taken substantially on the lines 3–3 of FIG. 1.

The aims and objects of the invention are accomplished by providing, in a lighting fixture specially engineered and constructed for use in "clean room" and containment environments, a hole-free, seam-welded housing, a lens assembly having a lens and a one-piece stainless steel beveled perimeter defining a continuous-angle lens retention capability, and a one-piece, closed cell, extruded, silicone gasket for sealing the lens frame to the housing and to the ceiling structure.

Additionally, there is provided a unique mechanical guide and support, carried by the fixture housing and engaging the lens assembly, for ensuring establishment of and for maintaining fastener alignment, and preventing distortion, while also providing overtorque protection. The above structural features, in combination with a specially configured and contoured sealing gasket of one-piece, extruded silicone plastics, ensures positive and exceedingly reliable and effective, fluid-impervious, enhanced sealing of the lens frame to the fixture housing and to the ceiling structure.

Adjustable, housing-mounted, swing-out brackets facilitate and simplify securement of the housing of the fixture in ceiling openings.

Referring now to the drawings, there is shown one preferred embodiment of the lighting fixture of the invention, provided for illustrative purposes, and not to be construed in any limiting sense.

The lighting fixture 20 illustrated (FIGS. 1 and 2) comprises an 18-gauge, hole-free, seam-welded housing 30 provided with a white urethane powder coat finish. In the embodiment of the fixture depicted, the fixture 20 is rectangular. As shown in FIG. 2, the housing 30 includes a top wall 34 and a depending, circumambient side wall 38 extending normally of the top wall 34, and unitary therewith. Attached at flanges 36 and 40, and projecting downwardly from an under surface 42 of the top wall 34 of the housing 30 is a pair of opposed, longitudinally-extending interior walls 46 and 48 which delineate lateral bounds of a chamber 52 in which illuminating lamps 54 and 56 are housed. The lamps 54 and 56 extend from and along a surmounting chassis 60 which is itself secured to the top wall 34 of the housing 30 at the undersurface 42 thereof. At their lower ends 62 and 64 the interior walls 46 and 48 are joined, respectively, to integral panels including downwardly and outwardly-angled panels 66 and 68, joined to horizontally-extending terminal panels 76 and 78, the latter terminating at and being fastened at the side wall 38 of the housing 30.

As best seen in FIG. 2, the circumambient side wall 38 of the housing 30 is formed, in a zone corresponding to the locale of the panels 76 and 78 of the interior panel configuration of the housing 30, with an outwardly projecting ledge-like flange or web 82 which bears on a supporting pedestal 86. At its outer limit of the web 82 the side wall 38 of the housing 30 projects along a vertical, downwardly directed section 88 to terminate in a radially-outwardly extending foot 90 which is seen in FIG. 2 as positioned on a sealing gasket 94 of the lighting fixture 20. Also, as shown in FIG. 2, the extending foot 90 of the side wall section 88 of the housing 30 underlies the ceiling structure 96 in which the fixture 20 of the invention is mounted.

Referring further to FIG. 2, the fixture 20 is provided at each of opposed sides thereof with adjustable, swing-out bracket assemblies 100. As shown, each bracket assembly includes an elongate pin holder 104 having a principal vertically-extending wall 106 overlying and secured to the outside surface of the side wall 38 of the housing 30. The wall 106 carries, at an upper end thereof, an outwardly directed tab or ear 108 having a hole downwardly through which a headed 110 bolt 112 extends to seat on a second ear 114 extending from a lower limit of the wall 106. An outwardly extending bar or mounting bracket 120 is threadedly supported on the shank of the threaded bolt 112, to be raised or lowered as the head 110 of the bolt 112 is turned. As illustrated, the mounting bar 120 is positioned to rest on a framing member or grid component 124 of a ceiling framing structure or grid 128 to support the fixture 20. The bolt 112 may be turned to elevate or to position the fixture 20 so that the ceiling panel or ceiling structure 96 is firmly retained between a lower flange 130 of the fixture-carrying ceiling grid 128 and the bottom flange 90 of the housing 30. A downwardly-projecting lip 132 integrally formed on the mounting bar 120 and disposed at an outer free end thereof prevents the supported fixture 20 from shifting laterally.

Unique structures in the lighting fixture of the invention include a novel bracket assembly and cooperating elements which function to prevent stress-derived distortion of the lens assembly and to preserve planar disposition thereof during draw-up; auxiliary components which ensure and preserve proper alignment of the lens frame fastener; elements which provide overtorque protection; and structures which serve as a mechanical guide for the fastener during securement of the lens-carrying lens frame. These structures are described in the following paragraphs with reference to FIGS. 3 and 4.

Figure 4:
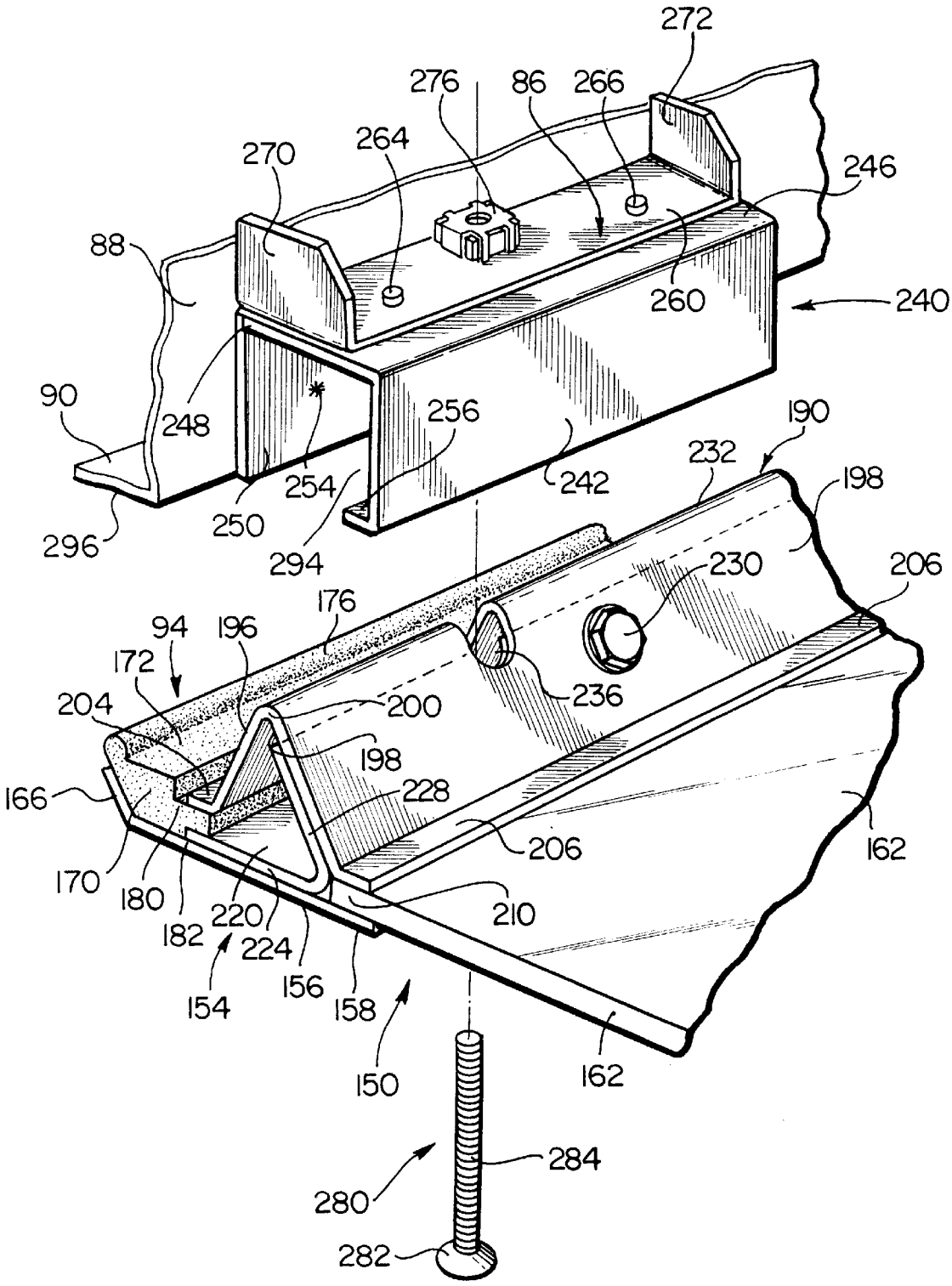
FIG. 4 is an exploded, perspective view showing, schematically, the manner in which the lens assembly of the fixture and a bridge spanning between the sealing gasket and the secured lens of the fixture is attached to the surmounting housing of the fixture.

The structure depicted in the lower portion of the exploded view constituting FIG. 4 shows the lens assembly 150 of the invention. At the lower left of the lens assembly 150 is a lens frame 154 consisting of a generally planar web 156 an inwardly directed end 158 of which supports a lens 162. At its opposite end the lens frame 154 is integrally formed, at an outer periphery thereof, with an upwardly-directed standing bevel 166.

Disposed to lie along an outermost end section the lens frame 154, and nestled against the standing bevel 166 of the lens frame 154 is the gasket 94 for establishing a fluid-impervious seal between the lens frame 154 and the housing 30 of the fixture 20. The gasket 94 is a one-piece, closed-cell extruded structure of silicone plastics composition. As seen in the cross section of the gasket in FIG. 4, the gasket 94 itself comprises a block-like body 170 having a principal upwardly-presented top surface 172 disposed in a generally horizontal plane. The body 170 is integrally formed at an outer upper end zone thereof with an uninterrupted, lineally-extending, upwardly and outwardly directed bead-like protrusion 176 which, upon final installation of the fixture 30 in place, resiliently engages and seals against a ceiling surface 178, as indicated in FIG. 2.

In the particular embodiment of the invention depicted, the body 170 of the gasket 94 is formed, in a regional zone radially inwardly of the protruding bead 176 and of the principal top face 172, with a stepped-down section defining a downwardly-stepped second bearing and sealing surface 180. At its most inwardly base section the gasket 94 is formed with an undercut defining a longitudinally extending, rearwardly-opening slot 182 (FIG. 4).

Referring now further to the structure depicted in the lower component of FIG. 4, there is shown a bridge 190 for bridging between the gasket 94 and the lens 162. The bridge #190 includes a pair of upwardly-extending walls 196 and 198 converging and joined 200 to one another at their upper ends. At their spacially-spaced, separated lower ends, the walls 196 and 198 terminate, respectively, with outwardly extending flange-like feet 204 and 206. These bear, respectively, on the gasket 94 at its stepped- down face 180, and on a lineally-extending end section 210 of the lens 162.

Completing the lens assembly 154 and its identified cooperating components, is a coupler or stabilizer consisting of an angle bar 220 disposed beneath and interiorly of the bridge 190. The angle bar 220 is co-extensive with the bridge 190 and has one leg 224 resting on a top surface of the lens frame web 156, with an end edge of the leg 224 sleevedly received in the slot 182 formed in the gasket 94.

The second leg 228 of the coupler 220 lies interiorly along the inwardmost wall 198 of the bridge 190 and is secured thereto by screws or bolts 230. The bridge 190 is formed at its apex 232 with a through port 236, the function of which is described herebelow.

Referring now, more particularly, to the upper drawing in FIG. 4, there is shown the novel mechanism and mechanical arrangement of physical elements which cooperatively coact and serve to prevent distortion of the lens assembly of the invention as the assembly is fastened to and drawn upwardly against the housing or chassis of the fixture. Overtorque is avoided, and a more effective and more reliable seal is produced.

In accordance with the present invention there is provided a support bracket assembly 240 which includes a vertical wall or brace 242 attached to and projecting downwardly from a surmounting, horizontal top wall 246 which is, in turn, secured 248 to a lower side wall section 88 of the fixture housing 30. In the embodiment of the invention illustrated, there is also provided a reinforcing panel 250 which abuts and is fastened 254 to the sidewall 88 of fixture 30 along and interiorly thereof. At its lowermost end, the bracing wall 242 is integrally formed with a flange 256 which, during final assembly, comes to bear upon the coextensive foot 206 at the lower end of the bridge wall 198, which, in turn, rests on the end edge 210 of the lens 162.

The support pedestal 86 of the device is generally U-shaped in form and consists of a floor panel 260 overlying and fastened 264 and 266 to the top wall 246 of the support bracket assembly 240. A pair of plates 270 and 272 integrally formed with the floor panel 260 at opposed ends thereof and extending upwardly therefrom engage and provide support for the housing 30 at its ledge-like flange 82 (FIG. 3). A nut 276 is secured to the top of the floor panel 260 in vertical correspondence or registry with a through hole in the supporting panel 260, and an aligned opening in the underlying panel 246 of the support assembly 240.

In order to attach the lens assembly 150 to the housing 30 of the fixture 20 to assume the configuration shown in FIGS. 3 and 4, there is provided a screw 280 having a head 282 and a threaded shaft 284. In assembling the fixture 20, the shaft 284 of the screw 280 is inserted upwardly through preformed, aligned holes 290 in the steel lens frame 156 and in the overlying leg 224 of the coupler angle bar 220, and up through the opening 236 at the apex 232 of the bridge 190. Continuing, the shaft 284 of the screw 280 penetrates and travels upwardly through the spatial channel 294 between the laterally spaced side walls 250 and 242 of the support bracket assembly 240, and, finally, through the top walls 246 and 260 of the assembly, threadedly to engage the cooperating threaded nut 276 secured to the top 260 of the support bracket assembly 240, all as indicated schematically in exploded FIG. 4.

As the screws 280 are tightened, the lens assembly 150 is elevated or drawn upwardly to bring the top, principal face 172 of the gasket 94 into positive engagement with an undersurface 296 of the foot-like flange 90 of the fixture 30. At the same time, the foot or flange 256 at the base of the inwardly-positioned wall 242 of the support bracket assembly 240 is brought to bear downwardly upon the support flange 206 of the bridge wall 198, and simultaneously against the edge 210 of the lens 162 and its supporting frame 158. As the screws 280 are tightened further, the seal between the lens assembly-carried gasket 94 and the housing element 90 is made more positive and becomes fluid-impervious. Concurrently, the upwardly-extending longitudinal bead 176 of the sealing gasket 94 is brought into sealing engagement with the ceiling structure 96 of the installation system.

An important and very beneficial effect of the support bracket arm or wall 242 of the fixture 30, located, as the wall 242 is, radially inwardly of the lens assembly securing screws 280, is to maintain the lens assembly lens 162 and the lens frame 156 in a plane normal to a vertical axis and to prevent damaging bending and distortion of the assembly 150 during installation. Proper, optimum alignment is assured. Overtorquing is effectively eliminated. The seals produced are more precise and more positive, exhibiting long, reliable and trouble-free lives.

What is claimed is:

1. A recessed lighting fixture adapted for use in sealed environments including cleanroom and containment environments, said fixture comprising:

a housing of unitary construction opening downwardly and having a continuous sealed enclosure;

a lens supporting assembly including a lens frame;

a lens supported on said lens frame;

gasket means for establishing a particulate and a fluid-impervious seal between said fixture and a ceiling structure;

said lens frame comprising a generally-planar web, said web being integrally formed at an outer periphery thereof with upwardly-directed, standing bevel means for abuttingly supporting said gasket means of said fixture;

lens frame fastener means extending from beneath and upwardly through said lens frame for engaging said housing, and for drawing said lens support assembly, including said gasket means, upwardly to abut said housing; and support fulcrum bracket means including wall means secured to said housing interiorly thereof for establishing a fulcrum position displaced inwardly of said lens frame fastener means for preventing physical distortion of said lens supporting assembly, for effecting a stressing and positive seal between said fixture and a ceiling structure to which said fixture is secured, and for preventing impairment of said seal.

2. A lighting fixture as set forth in claim 1, and further comprising an inert, fluid and vapor-impervious coating composition bonded to said outer surface of said housing over an entire expanse thereof.

3. A lighting fixture as set forth in claim 1, and further comprising a generally U-shaped bracket including a base panel and a pair of spaced segmental walls; said walls extending upwardly of said base panel at opposed ends thereof;

said base panel overlying and bearing upon said top wall of said support bracket means; and said segmental walls extending upwardly of said base panel at opposed ends thereof.

4. A lighting fixture as set forth in claim 3, wherein said U-shaped bracket constitutes an interior support for said lens frame.

5. A lighting fixture as set forth in claim 1, wherein said gasket means comprises a one-piece extrusion of a resilient plastics composition devoid of open pores.

6. A lighting fixture as set forth in claim 1, wherein said gasket means comprises an extruded silicone plastics composition.

7. A lighting fixture as set forth in claim 1 and further comprising bridge means for bridging between said gasket means and said lens; and said bridge means including at respective lower ends thereof, outwardly-directed wing means for engaging, respectively, said gasket means and said lens.

8. A recessed lighting fixture as set forth in claim 1, and further comprising an angular coupler plate including a first wall lying along and abutting said lens frame, and a second wall lying along and abutting said bridge means, and means for attachably securing said angular coupling plate to said bridge means.

9. A recessed lighting fixture as set forth in claim 1, and further comprising:

a bridge assembly bridging between said gasket means and said lens;

said bridge assembly including a pair of upwardly-extending walls converging and joined to one another at upper ends of said walls, and said walls diverging and being spaced from each other at lower ends thereof;

said upwardly extending walls of said bridge assembly being disposed to invade a downwardly-opening chamber in said fixture, lateral bounds of said chamber being deliniated by said side wall of said housing and said wall means of said support bracket means;

coupling means for mechanically coupling said bracket means with said lens frame; and said walls of said bridge assembly being disposed to bear, at lower free extremities thereof, respectively on said gasket means and said lens.

10. A lighting fixture as set forth in claim 9, wherein said gasket means comprises a body integrally formed at an upper zone thereof remote from said housing with an uninterrupted lineally-extending, outwardly and upwardly-directed protrusion; said protrusion constituting bead means for resiliently engaging and sealing with a surface of a ceiling structure presented thereagainst.

11. A recessed lighting fixture as set forth in claim 1, and further comprising bridge means for bridging between said gasket means and said lens, said bridge means including walls having lower ends integrally formed with outwardly-projecting plate means for overlying and for establishing firm and positive surface-to-surface contact with respective said gasket means and said lens.

12. A lighting fixture as set forth in claim 1, and further comprising mounting bracket means carried by said housing for projecting outwardly of said side wall of said housing for bearing on a fixed, lattice-like framing structure during functional employment of said fixture.

13. A lighting fixture as set forth in claim 12 wherein said mounting bracket means includes an arm-like bar, and rotatable screw means for elevating and for lowering said bar threadedly corrected to said screw means and projecting outwardly therefrom, and fastener means for functionally securing said screw means to said housing at said side wall thereof.

14. A lighting fixture as set forth in claim 1, wherein said lens frame fastener means comprises an elongate screw extending from below said lens frame and generally upwardly to engage cooperating nut means carried by said top wall of said support bracket means for facilitating controlled application of upward compression forces of said lens support assembly against said housing in a zonal area of contact of said lens support assembly therewith.

15. A lighting fixture as set forth in claim 14, wherein said lens frame fastener means operates to draw said lens support assembly upwardly to engage and seal with said housing; and wherein said wall means of said support bracket means is positioned radially inwardly of said lens frame fastener means to generate, during the drawing of said lens support assembly upwardly, vector forces promoting the preservation and maintenance of a planar and horizontal configuration of said lens frame and of said lens support assembly as said lens support assembly is forcibly urged and drawn upwardly by lifting forces generated as said screw of said lens frame fastener means is turned.

16. A lighting fixture as set forth in claim 15, and further comprising sealing means disposed between said lens and said lens frame for establishing a fluid-impervious seal therebetween.

17. A lighting fixture as set forth in claim 1, wherein said bracket means comprises mechanical guide means for protecting and preserving configuration and alignment of said lens frame fastener means, and for obviating objectionable overtorque upon application of elevating forces to said lens supporting assembly, applied through said lens frame fastener means.

18. A lighting fixture as set forth in claim 10, and wherein said body of said gasket means is formed, adjacent said bead means and coextensively therewith, with a generally planar principal top surface for stressingly bearing against and sealingly engaging a ceiling surface structure against which said lighting fixture is installed.

19. A lighting fixture as set forth in claim 18, wherein said body of said gasket means is formed, in a zone thereof radially inwardly of said bead means and said principal top surface of said gasket means, with an uninterrupted, lineally-extending, stepped-down sector having an upwardly-presented, generally planar surface for contiguously engaging a lower free extremity of a wall of said walls of said bridge means bearing thereon.

20. A lighting fixture as set forth in claim 18, wherein said body of said gasket is formed, at an innermost sector of said body, with an undercut defining in said body a rearwardly-opening recess for receiving therewithin a lower end segment of one of said walls of said bridge means, in sealing engagement therewith.

21. A lighting fixture as set forth in claim 1, wherein said gasket means is contoured to provide, in a structural zone remote from and below said housing, an upwardly and outwardly directed surface for seating against that portion of said lens flame defining said standing bevel thereof.

22. A lighting fixture as set forth in claim 3 and further comprising nut means for functionally engaging a securement screw projecting upwardly from said lens, and for elevating said lens to engage said housing of said lighting fixture; and fastener means for bonding said nut means to said base panel at an upper surface thereof.

* * * * *